United States Patent [19]

Spatz

[11] Patent Number: 4,671,428

[45] Date of Patent: Jun. 9, 1987

[54] DISPENSER FOR FLUENT MASSES

[76] Inventor: Walter B. Spatz, 1141 Donaire Way, Pacific Palisades, Calif. 90272

[21] Appl. No.: 798,416

[22] Filed: Nov. 15, 1985

[51] Int. Cl.[4] ..... B65D 35/56; B65D 37/00

[52] U.S. Cl. ..... 222/105; 222/107; 222/207; 222/209; 222/213

[58] Field of Search ..... 222/105, 106, 107, 206, 222/207, 209, 213

[56] References Cited

U.S. PATENT DOCUMENTS

| | | | |
|---|---|---|---|
| 3,211,340 | 10/1965 | Zander et al. | 222/105 X |
| 3,220,611 | 11/1965 | Zander et al. | 222/105 X |
| 3,870,200 | 3/1975 | Spatz | 222/206 |
| 3,963,147 | 6/1976 | Waters | 222/105 X |
| 4,457,454 | 7/1984 | Meshberg | 222/209 X |
| 4,457,455 | 7/1984 | Meshberg | 222/105 |

*Primary Examiner*—Frank E. Werner

*Assistant Examiner*—Jay I. Alexander

*Attorney, Agent, or Firm*—Beehler, Pavitt, Siegemund, Jagger, Martella & Dawes

[57] ABSTRACT

An improved dispenser for fluent masses such as toothpaste, lotions, chemicals and the like, includes a body member having a chamber which receives a collapsible and flexible pouch. Associated with the body member is a pumping chamber preferably comprised of a lower and upper housing. The pump chamber, pouch and discharge aperture of the dispenser are at essentially ambient atmospheric pressure, and there is provided a check valve mechanism which sequentially permits flow of material from the pouch into the pump chamber as material is discharged from the discharge spout. The discharge spout is configured and arranged to inhibit flow of air through the discharge spout back into the pump chamber. Various structures and arrangements are described.

15 Claims, 6 Drawing Figures

FIG. 3
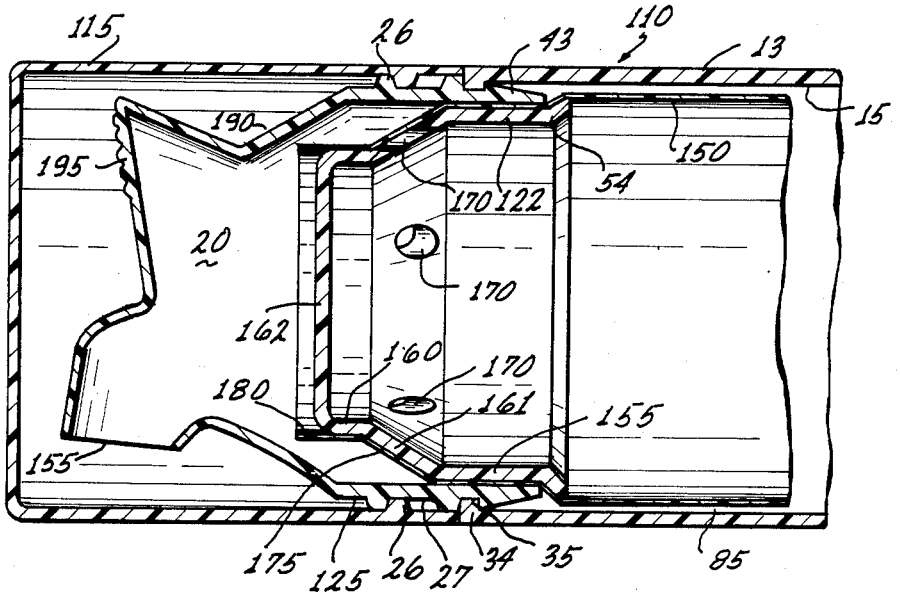
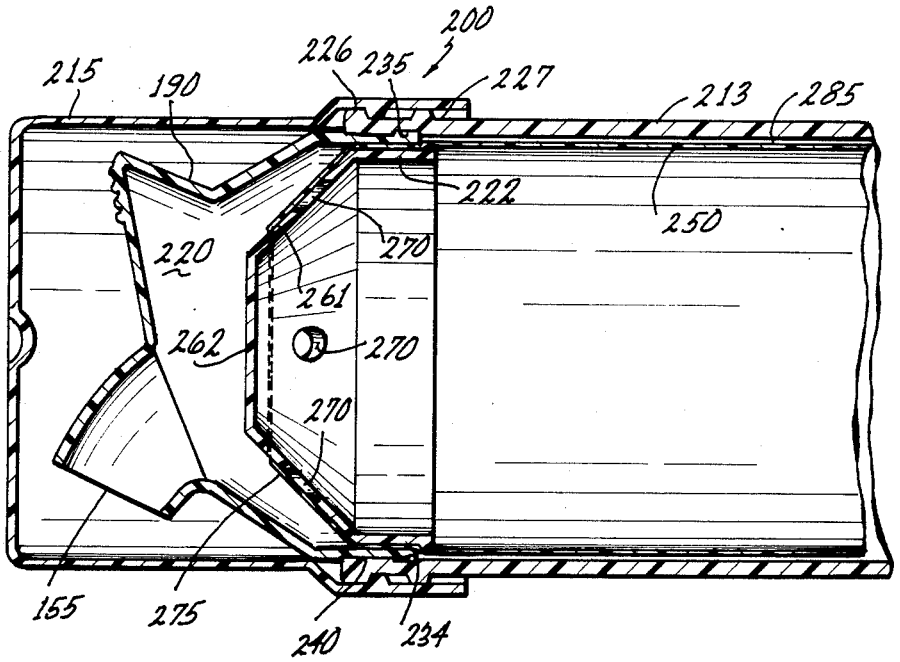
FIG. 4

DISPENSER FOR FLUENT MASSES

BACKGROUND OF THE INVENTION

Field of the Invention

The present invention relates to a dispenser and more particularly to an improved dispenser for fluent masses such as toothpaste, lotions, semi-solids and chemicals, and the like, in which the dispenser includes a collapsible pouch containing the material to be dispensed.

It is well known in the prior art to provide what is known as a bag-in-can type of dispenser, the latter also sometimes referred to as barrier packages. Typically, these products include an inner collapsible tubular bag-like inner container which holds the material to be dispensed, usually a relatively easily dispensible material of the type normally dispensed from an aerosol type of container. The power needed to dispense the material within the inner container is normally provided by a gaseous propellant such as Freon gas or a hydrocarbon or mixture of hydrocarbon gases, initially in liquid form. The outer container is structured as an aerosol dispenser with the usual valve and, in manufacture, the assembly is normally pressurized above ambient pressure from the bottom and plugged in the bottom with a seal, usually a rubber plug.

The interior of such devices may vary. In one case, a relatively rigid dip tube having perforations along the length thereof is used so that the material is discharged through the tube to the can valve, the above atmospheric gas pressure surrounding the inner flexible bag being operative to force the contents into the dip tube and out the valve. In another form, the inner container is pleated, i.e., accordion folded, and the above atmosphere gas pressure operates to compress the pleated inner container. In the latter system, depending upon the viscosity of the material being packaged, it is sometimes necessary to spin the assembly during filling of the inner container in order to assure that there are no air pockets in the inner pleated container. In some variations, the inner bag was pleated axially rather than radially.

Other aerosol type containers use a plastic float or piston which separates the interior of the outer can into two chambers, the bottom being a pressurized gas or initially liquid propellant gas and the side opposite the gas being the material to be dispensed, sometimes a rather viscous material. In this type of dispenser, it is usually necessary to provide a seamless can body in which the walls are essentially truly parallel in order to effect a seal along the periphery of the float or piston member.

In other variants, the inner bag is pressurized with the gas while the contents to be dispensed are located in the region between the inner bag and the inside wall of the outer can body. Such an arrangement, however required a much larger propellant charge than in the other systems mentioned.

In an attempt to avoid the use of aerosol containers, due to the ecology problem with Freon gases and the potential flammability of hydrocarbon gas propellants, "pressurized" dispensers were used. In a typical system of this type, a double bladder was used inside of an outer container to dispense the contents of the material within the bladder, the latter exerting a constant pressure on the contents, to discharge the same, as it returns to is initial shape.

Other forms of dispensers are those shown and described in U.S. Pat. Nos. 3,088,636; 3,268,123, 3,255,935; 3,768,705; and 3,870,200. In general, these devices are pump type dispensers in which the material to be dispensed is a fluent mass such as toothpaste. The outer container, fabricated of plastic, includes essentially parallel side walls and of a sufficient thickness to be relatively rigid. Pumping was achieved through a pump chamber cooperating with the contents chamber such that as the pump was actuated material in the chamber was dispensed, and material from the contents chamber entered the pump chamber. The bottom end of the pump chamber was closed by a piston, movable axially along the length of the contents chamber, each time the pump was actuated. Thus, the walls of the pump chamber were parallel, smooth and of sufficient thickness to resist deformation during a pumping action. Further, the piston or float was structured to permit movement in one direction while resisting movement in the other direction, while providing a seal to the cooperating wall along the length of the wall. The contents were in direct contact with the wall and the piston thus necessitating that the material of the wall and piston be compatible with the contents.

The dispensers of the above patents operate quite well, especially for relatively viscous materials such as toothpaste, lotions and other similar materials as well as free flowing liquid materials, but are relatively expensive for products which are sold in large volumes and in which the costs of packaging are significant considerations. Thus, for example, a plastic body which is of sufficient thickness to be rigid is more expensive than essentially the same body of a material of thinner cross-section, merely in terms of material costs. It is also true that a reduction in wall dimension allows faster molding cycles. The need to provide controlled geometry due to the need for smooth and parallel interior walls tends to increase the costs of the tooling and part production, but also restricts the package design to a generally cylindrical body. Further, the need to fashion a float or piston member which seals to the interior of the cylindrical body also tends to require mating parts of relatively high precision. Also a factor is the need to provide a float or piston capable of effectively sealing to the side wall and which is moveable in one direction, but which resists movement in the other direction. Since the packaged material is in direct contact with the wall of the chamber within which it is contained, the barrier qualities of the wall may not be as desirable as might be needed for certain types of products.

It is thus an object of the present invention to provide a relatively simple pump type dispenser for fluent materials which is relatively simple in design, effective in operation and which does not include a movable piston or float assembly.

It is also an object of this invention to provide a dispenser for fluent materials of the type to be described in which ambient pressure is used as the power source in a pump type dispenser in which the material to be dispensed is contained within a flexible and collapsible bag-like member and wherein ambient pressure effects passage of the dispensed material to a pump chamber.

Another object of this invention is the provision of an improved dispenser for fluent materials in which the material is discharged from a pump chamber which in turn is filled from a flexible bag-like member, substantially free of trapped air or compressible gases, and contained within a body member and in which the walls of the bag are spaced from the wall of the body member to form an air gap, at essentially ambient pressure, in order to dispense material in the bag and to increase the barrier qualities of the overall package.

BRIEF DESCRIPTION OF THE INVENTION

In accordance with the present invention, an improved dispenser for fluent masses is provided which is relatively simple in construction, relatively easy to manufacture and to use and which offers noticeable reduction in costs of the package.

The improved dispenser of this invention may be used to dispense various fluent materials such as toothpaste, lotions, relatively viscous materials such as filled plastics and hardeners and other types of chemicals as well as fairly fluent liquids of a lower viscosity. The dispensing mode is that of a pump assembly which does not rely upon a pressurized gas, but rather a system in which all components are at ambient atmospheric pressure.

In brief, the dispenser includes a body member and an associated pumping assembly composed of a pump and a pump chamber, the latter including a discharge spout of the type to be described. The body member includes a body chamber, associated with the pump chamber, the body chamber containing a bag or pouch which is flexible and collapsible and which contains the material to be dispensed. The pouch is preferably supported such that there is an air gap between the inner walls of the body chamber and the outer surface of the pouch, the pouch and the air gap being essentially at ambient atmospheric pressure, i.e., normally there is no pressure differential from the air gap to the pouch interior.

In a preferred form, the bag is supported by a lower pump chamber wall component, and between that component and the body which supports the wall, such that a portion of the bag overlies a portion of the pump chamber wall. The pump chamber wall includes at least one aperture which permits selective communication between the pump chamber and the interior of the pouch. In a preferred form the aperture effectively constitutes a one way check valve allowing passage of material from the pouch to the pump chamber but not in the reverse direction.

In one form, the pump chamber is formed by the volume between the pump chamber wall and an upper pump chamber wall, the latter provided with a discharge spout. Other forms of pump and discharge arrangements will be described.

The pouch is essentially filled with the material to be dispensed, the interior being at essentially ambient atmospheric pressure and being essentially free of compressible gas within the pouch, so that there are no gas pockets or bubbles within the pouch. So too, the pump chamber is filled with the material to be dispensed and, again, it is preferred that there be little, if any, gas entrapped within the material within the pouch, although gas pockets in the pump chamber are of less concern than if present in the pouch. In a preferred form the discharge spout of the pump is structured to prevent air from entering the pump chamber through the discharge spout.

The operation of the pump is preferably sequential in nature such that during one phase of the operation the volume of the pump chamber is reduced to force material in the pump chamber out of the discharge spout, the check valve being operative to prevent flow of material from the pump chamber back into the pouch. In the other phase of the operation of the pump, the pump chamber is effectively returned to its original volume, and a vacuum tends to form in the pump chamber. During this other phase of the operation of the pump in which a partial vacuum is created, air is prevented from being drawn into the pump chamber through the discharge spout, thus allowing material to flow from the interior of the pouch into the pump chamber since the pressure in the pump chamber, during this phase of pump operation is temporarily less than that in the pouch. Passage of material from the interior of the pouch to the pump chamber is assisted by the fact that the pressure on the outer surface of the pouch is greater than that which temporarily exists inside of the pump chamber. It is for this reason that the interior of the pouch is preferably free of sufficient gas pockets so that the pressure outside of the pouch acts on the pouch wall and applies pressure to the material within the pouch rather than having the pressure absorbed by the attempted compression of a gas pocket within the material within the pouch.

It is for the above reasons and to provide proper operation of the dispenser of this invention that ambient air must be free to occupy the space between the outer surface of the pouch and the facing wall of the body chamber. This is easily accomplished by the use of a base for the housing which encloses the body chamber, while permitting unobstructed flow of air into the air gap. The air gap also provides an improved barrier in that the material is not directly in contact with the wall of the pump chamber and the small air gap tends to inhibit diffusion through the pouch wall once an equilibrium condition is established.

In the case of fairly viscous materials, such as toothphaste and the like, the discharge spout is in the form of an orifice whose cross-sectional area and length are related such that the material in the orifice is not drawn back into the pump chamber. In the case of easily flowable materials such as liquids and light lotions, a check valve may be used in the spout such that atmospheric pressure on the outside surface causes the valve to seat, while increased pressure on the inside surface causes the valve to unseat allowing discharge of the material.

As is apparent from the foregoing brief description, the interior wall surface of the body chamber need not be smooth and geometrically cylindrical, nor does the wall have to be sufficiently thick to be rigid, as was the case with the prior art devices discussed. Further, neither the dispenser package container nor the contents thereof are pressurized by a gas which harms the environment or which creates a flammability problem. The contour of the outer housing need not be cylindrical in order to provide a cylindrical bore. By this invention it is possible to use a tapered conical body member whose base diameter is greater than the diameter at the top, and with far less material than would be necessary where a truly cylindrical bore is necessary. For example one could use a second outer body with the prior devices in addition to an inner body having a cylindrical bore, however, the added costs for the outer body, which is non-functional, may not be justified in order to achieve an aesthetic design which is more appealing to the consumer.

One of the significant advantages, however, is the elimination of the moveable float and the precision of the parts needed to effect a seal while permitting the float to move axially within the body bore, but only in one direction.

The invention possesses many other advantages, and has other purposes which may be made more clearly apparent from a consideration of the preferred forms in which it is embodied. These forms are shown in the drawings accompanying and forming part of the present specification. They will now be described in detail for the purpose of illustrating the principles of the present invention; but the following detailed description is not to be taken in a limiting sense.

BRIEF DESCRIPTION OF THE DRAWINGS

FIG. 3 is a fragmentary view, partly in section and partly in elevation, illustrating a modified form of the dispenser in accordance with this invention;

FIG. 4 is a fragmentary view, partly in section and partly in elevation, of yet another form of the dispenser in accordance with the present invention;

DETAILED DESCRIPTION OF THE INVENTION

Figure 1:
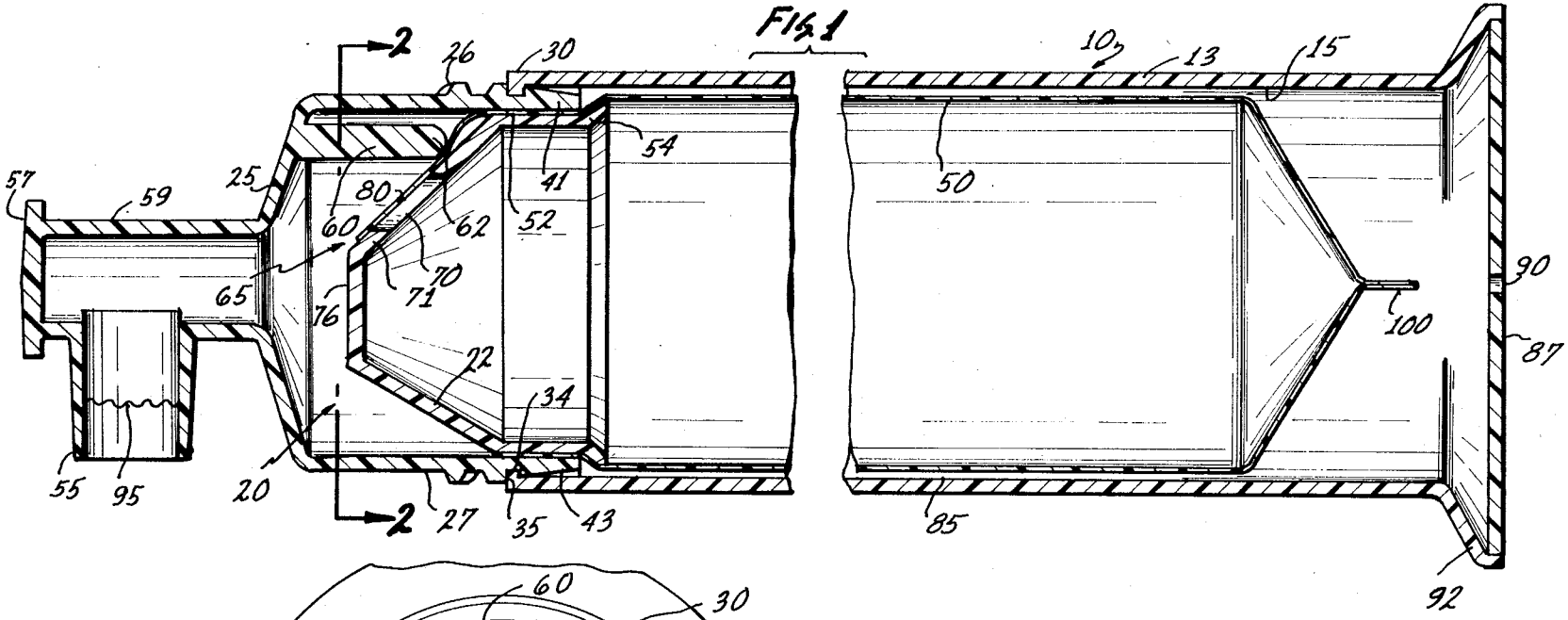
FIG. 1 is a view, partly in section and partly in elevation of the improved dispenser in accordance with the present invention.

Referring to the drawings which illustrate preferred forms of the present invention, FIG. 1 illustrates the improved dispenser 10 of the present invention, the latter including a body 13 which may be a variety of shapes. For purposes of simplicity, the shape illustrated is cylindrical and the body is preferably made of any of the well known plastic materials. The body member 13 is hollow as indicated at 15, the interior of the body member forming a body chamber.

Cooperating with the body chamber 15 is a pump chamber generally designated 20 and composed of a lower housing 22, again fabricated of plastic and being relatively rigid, as is the body member 13. Received over the lower housing of the pump chamber 22 is an upper housing generally designated 25, the latter being provided with interrupted threads 26, around the outer periphery 27 the latter being slightly less in diameter than the body member 13, as illustrated. The threaded section receives a cap member not shown in this figure. The threads may be of a four or six or even eight start helix to prevent racheting and are preferably of a relatively steep helix configuration.

The upper end 30 of the body member 13 includes a radially inwardly extending flange 34 which is received in a corresponding annular groove 35 provided in the outer periphery 27 of the upper pump housing 25, the outer configuration of the upper housing being of the same general geometric shape as the upper end 30 of the body member 13. The upper pump housing 25 includes a lower portion 41 having a tapered end section 43 for ease of assembly and reception into the upper end of the body member, as described.

Received within the body chamber 15 is a flexible and compressible pouch or bag 50 which normally contains the material to be dispensed. In the form illustrated the pouch includes an upper portion 52 which is received between the lower end section of the lower housing and the lower section of the upper housing, as shown, and is clamped in sealing air tight relation between the opposed lower portions of the housings. The lower end of the lower housing is preferably provided with a radially outwardly extending flange 54 which abuts the lower end 41 of the upper housing to prevent axial movement of the lower housing into the upper housing of the pump assembly.

The upper housing 25 is of resilient material such as a synthetic elastomeric type of plastic, well known, and is provided with a discharge spout 55. A typical such elastomeric material is that available under the trademark "HYTREL" from du Pont, for example. For convenience, a button 57 is provided as shown, at the top of a hollow annular section 59 which communicates with the pump chamber 20. In effect the pump chamber is essentially the entire volume between the facing walls of the upper and lower pump housing sections. Resilient means are provided in the pump chamber 20 to bias the flapper valve, as will be described. In the form illustrated the resilient means is in the form of a resilient depending finger 60, the end 62 of which bears against the flapper valve 65. The finger may also be deformed by pressure on the button 57 to compress the volume of the pump chamber 20 and when the button is released, the finger 60 tends to revert to the position illustrated in FIG. 1. The finger bears against the flapper valve to bias it to the closed position.

Figure 2:
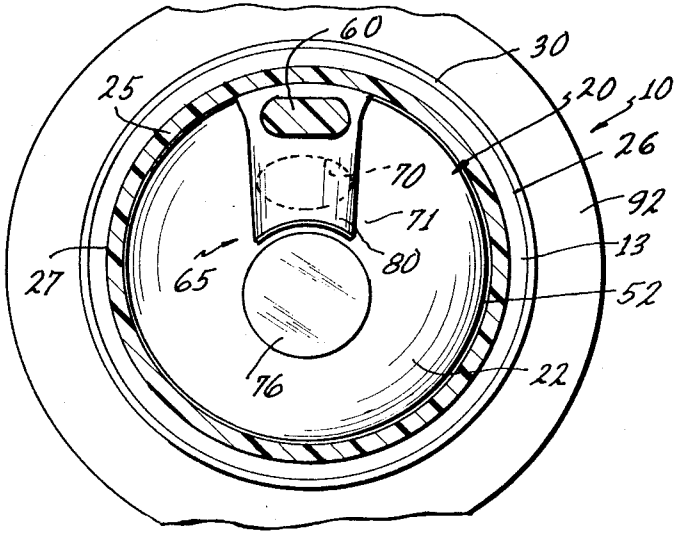
FIG. 2 is a sectional view taken along the line 2—2 of FIG. 1.

As illustrated in FIGS. 1 and 2, the pump chamber is provided with means to permit material in the pouch to flow into the pump chamber while preventing material in the pump chamber from back flowing into the pouch. In the form illustrated this is accomplished by a flapper type of valve 65 which functions effectively as a one way check valve. The valving action is provided by an aperture 70 in the sloped side wall 71 of the of the lower housing 22 and preferably off-center with respect to the center axis of the body and off-center with the center section 76 of the lower housing. The aperture may be of the configuration illustrated in FIG. 2, that is, arcuate, especially if the material to be dispensed is of a viscosity such as toothpaste and the like. The upper end of the pouch, above where it is sealingly gripped between the upper and lower pump housings includes a flap element 80 which overlies the aperture 70 and which is of a somewhat larger surface area than the area of the aperture. The finger 60 bears against the flap element to assure that the flap pivots during operation.

The pouch 50 is supported, as described such that the outer surface of the pouch is in spaced relation to the facing wall of the body chamber 15, thus forming an air gap 85. The pressure in the air gap 85 is essentially ambient pressure, that is, the air gap is not pressurized above essentially ambient atmospheric pressure. As shown, the body 13 is provided with a bottom closure assembly 87, the latter provided with an aperture 90 to permit free flow of air into the gap 85. In the form illustrated, the body includes an outwardly flared base 92 so that the dispenser may easily stand upright on the base.

In assembly of the dispenser 10 of this invention, the limp and flexible pouch, having one end configured to form the flapper valve is assembled over the lower housing 22 such that the valve 80 overlies the aperture 70. Thereafter, the upper housing is assembled to the lower housing to clamp the upper end 52 of the pouch in place as already described. Next, the body is slipped over the open ended pouch and the flange 34 is snapped into the mating groove 35. At this point in the assembly, the pouch is open ended.

The contents to be dispensed are then introduced into the dispenser as follows. The material is introduced into the open end of the pouch and is caused to flow into the pump chamber 20 by flow through the flapper valve assembly 65 such that the material essentially fills the entire volume of the pump chamber and enters into and partially fills the discharge spout 55 to a point indicated generally at 95. Filling is continued until the pouch itself is filled and the dispenser contains the desire amount of material. Thereafter a slight vacuum may be drawn to purge any air bubbles that may have formed during the filling operation. Then the open end of the pouch is heat swaged to seal the bottom end 100, with appropriate steps taken to assure that neither the pouch nor the pump chamber contain any significant entrapped air bubbles. The filling techniques are themselves well known. The bottom closure assembly 87 is then put in place and a cover member is mounted on the upper housing to complete the operation. It is understood that other filling techniques may be used, for example, the dispenser may be filled through the discharge spout.

Thus assembled and filled, there is essentially ambient atmospheric pressure in the pump chamber, in the interior of the pouch and in the air gap 85.

In operation, the cap is removed by unscrewing it and the button 57 is pushed towards the lower housing 22 in order to decrease the volume of the pump chamber 20 since the upper housing is flexible. The decrease in the volume of the pump chamber causes material to exit the discharge spout, and the valve assembly 65 prevents material from flowing into the pouch. In this phase of the operation, the pressure in the pump chamber is slightly greater than that in the pouch, the latter being essentially at ambient atmospheric pressure. As the button 57 is released, the finger 60 urges the upper housing back to its original shape and in so doing a slight vacuum is created in the pump chamber. The result is that the valve assembly 65 is momentarily opened and atmospheric pressure on the outside of the pouch causes flow of a portion of the contents of the pouch into the pump chamber to replace that which was dispensed.

To prevent air or contents from being sucked back into the pump chamber through the discharge spout, the discharge spout may be fabricated to be a check valve, as described for example in U.S. Pat. No. 3,870,200. This type of check valve action is particularly effective where the material being dispensed is of moderately high viscosity, such as toothpaste and the like. As further amounts of the contents are dispensed, the flexible pouch 50 is progressively collapsed by the ambient atmospheric pressure in the gap 85.

From the operation thus described, it becomes apparent that the amount of entrapped air in the system may cause the dispenser to malfunction. While the system need not be absolutely free of entrapped air, the presence of air in the pump chamber or the pouch or both may reduce the amount of material dispensed. If enough air or other compressible gas is present, either as a large gas pocket or finely distributed gas bubbles, a condition may be reached in which the sequential pressure exchanges operate to compress the entrapped gas rather than to dispense the material.

The upper and lower housings and the body member may be initially formed by any of the well known plastic processing operations. One of the principal advantages of this invention is the fact that the interior of the body chamber need not be geometrically cylindrical since a moveable piston is not used. Further, the walls of the body may be thinner than those used in prior devices since only ambient pressure is involved. Another advantage is that the material being dispensed is not in direct contact with the body chamber wall and the air gap acts as a barrier which assists in reducing dissipation of vapors out of the dispenser. Further, the pouch made be made of any of a wide variety of pliable and limp plastic materials or composite plastic materials depending upon the nature of the material being dispensed. The form illustrated in FIG. 1, as already mentioned is especially adapted to be used with materials having the flow qualities of toothpaste, for example.

The dispenser illustrated in FIG. 3 is similar to that of FIGS. 1 and 2, and thus the same reference numerals have been used where applicable. This form of dispenser 110 includes a body 13 and a body chamber 15, the body being provided with the flange 34 for reception in the groove 35 of the upper housing 125, the latter including the tapered end 43 and threads 26 on the periphery 27 for reception of a cap member 115. The lower housing 122 is again of rigid material, preferably of plastic and cooperates with the upper housing 125 to form the pump chamber 20. The lower housing 122 also includes the outwardly extending flange 54, as already described, with the pouch 150 mounted and secured as previously described.

The lower housing 122 includes a pair of spaced walls 155 and 160 with a sloping wall section 161 interconnecting the same, as shown, and closed by a top wall section 162. Provided in the sloping wall section 161 are a plurality of apertures 170, for example five, for flow of material from the pouch into the pump chamber 20. In this form, the pouch 150 includes a neck portion 175 which engages the side walls 155 and 160 and the sloping wall 161 essentially along the entire outer periphery of the lower housing. The pouch also includes an end section 180 which extends beyond the upper top wall 162 of the lower housing. As previously described, the neck portion 175 of the pouch cooperates with the apertures 170 to form a valving arrangement for control of flow of the material being dispensed between the pouch and the pump chamber essentially in the same manner as previously described.

The upper housing 125 is constructed of resilient material but includes wall portions 190 which are somewhat thinner than the cross section of the peripheral wall 27 in which the threads are formed. Also provided in the upper housing is a discharge spout 155 which forms a check valve as described. The discharge spout may be rectangular having a height of 0.30 of an inch and a width of 0.15 of an inch, for example. It is also possible to use a circular spout having a diameter of about 0.22 of an inch. The upper housing includes a button section 195 in what is essentially the top wall of the upper housing. In this particular instance, the upper housing 125, by virtue of its configuration and construction is inherently sufficiently resilient to spring back to its rest condition, essentially in the configuration illustrated in FIG. 3. The balance of the dispenser may be as already described in connection with FIG. 1 including the air gap between the pouch and the body chamber wall, while the lower end of the pouch and body may be as previously noted.

The assembly, filling and operation of the dispenser of FIG. 3 are essentially as already described, except that this particular form is preferred for dispensing lotions which are of somewhat lesser viscosity than toothpaste types of materials, although the form illustrated in this figure may also be used to dispense those types of materials. The advantage of this particular form is the relative simplicity of the upper housing structure both from an operational and manufacturing point of view.

The form of dispenser 200 illustrated in FIG. 4 is a variant of those previously described in that the upper housing 222 is similar to that of FIG. 3, and is received in the body 213, the latter having the threads 226 on the outer periphery 227 thereof for reception of a cap member 215. In this form, the groove 235 is in the body member 213 while the shoulder 234 is in the lower end of the upper housing. The lower end of the upper housing includes a second annular recess 240 which receives a shoulder provided at the upper end of the body member. Again the pouch 250 is clamped in sealing relation between the upper housing and the lower housing and supported in the body chamber 215 to form an air gap 285 as described.

The pump chamber 220 is provided between the upper and lower housings, and the lower housing includes a plurality of apertures 270 cooperating with that portion 275 of the pouch which extends up the sloped side wall 261 of the lower housing and which is enclosed by the upper wall 262.

The operation of the dispenser as shown in FIG. 4 is essentially as already described as is the assembly and filling thereof.

Figures 5, 6:
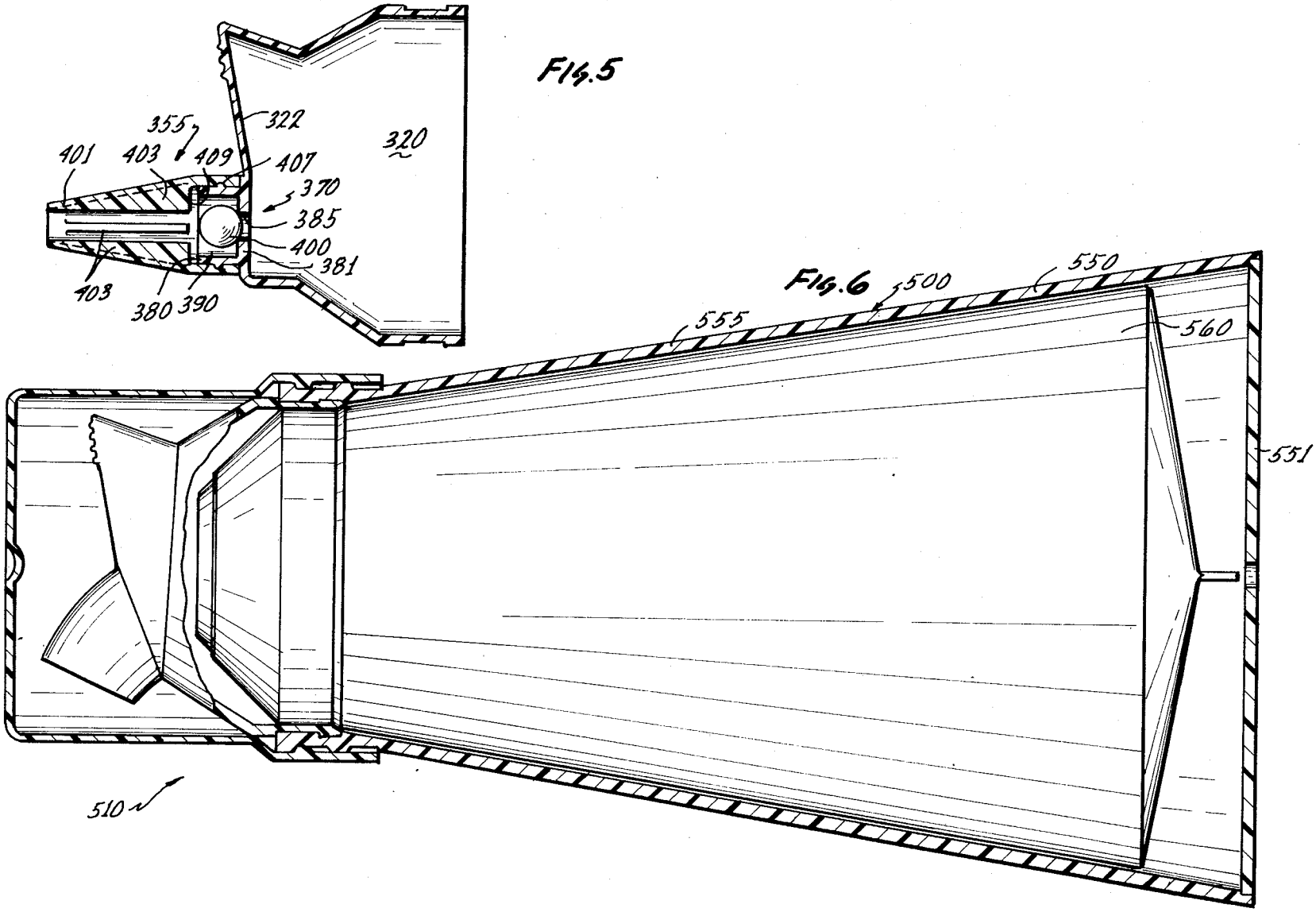
FIG. 5 is a fragmentary view, partly in section and partly in elevation, of a dispenser spout which includes a check valve in accordance with the present invention.
FIG. 6 is a diagrammatic view of another form of the improved dispenser in accordance with the present invention.

In the event that it is desirable to use a dispenser in accordance with the present invention with fluent masses that are readily flowable, the upper housing may be modified as illustrated in FIG. 5. There, the upper housing 322 is essentially as described in connection with either FIGS. 3 or 4, as is the balance of the dispenser. The discharge spout 355, however is in the form of a check valve assembly 370, which may be in the form of a ball check valve. Thus the upper housing 322 includes an annular extension 380 whose bottom wall 381 is provided with an aperture which communicates with the pump chamber 320. The extension forms a ball chamber 390 containing a freely moveable ball element 400 which is configured to seat and seal against the aperture 385. Cooperating with the extension 380 is a nozzle 401 whose interior includes a plurality of spaced and axially extending ribs 403, the nozzle being sealingly secured to the extension by a shoulder and groove joint 407 as shown. The interior surfaces of the ribs form an opening of a diameter smaller than that of the ball, and the bottom end 409 of the ribs is spaced axially from the aperture 385 and the bottom wall 381 such that the ball is able to move axially a small distance.

In operation, depressing the button 357 temporarily increases the pressure in the pump chamber 320 to force the ball 400 off the seat allowing the contents to be dispensed as a spray or stream. As the button moves to the rest position, the ball seats and fluid is drawn from the pouch.

The dispenser 500 illustrated in FIG. 6 may include a pump assembly and spout arrangement 510 which may be as already described in connection with the other units described. In the case of dispenser 500, the body 550 is configured to have a cross-section which is non-uniform along its length, i.e. conical rather than cylindrical. In accordance with this invention, it is possible for the body member to be of various shapes since a cylindrical body is not necessary for the dispenser to function as described. In this view, the body includes a base 551 whose diameter is greater than the upper body portion 555, and the pouch 560 may be shaped accordingly. The advantage of the shape illustrated in FIG. 6 is that it is stable when placed on its base, even though some of the contents have been dispensed. In effect the dispender does not become top heavy as the contents are progressively dispensed. Further, the ability to form the body in a non-cylinrdical shape allows a simple way to increase the capacity of the dispenser without making it unduly long, simply by increasing the diameter. It is apparent that the body may be of a cylindrical diameter larger than the upper body end, i.e., a cylindrical lower body portion of much larger diameter than the pump section.

It is apparent from the foregoing detailed description that an improved dispenser for fluent materials is provided which is easy to use, easy to manufacture, less expensive to make in comparison to some of the prior art devices and which does not involve pressurized propellants. It will also be apparent to those skilled in the art that various modifications may be made, based on the detailed description herein and that such modifications are deemed within the scope of the present invention as set forth in the appended claims.

What is claimed is:

1. A pump type dispenser for fluent material comprising:

a container having a pump chamber and a body member, said body member including an interior wall portion forming a body chamber, a flexible and collapsible pouch supported within said body chamber with at least portions thereof spaced from the interior wall portion of said body member to form an air gap therebetween, said air gap being essentially at ambient pressure, said pouch containing the material to be dispensed, said pump chamber including a discharge spout and being essentially filled with material to be dispensed, means cooperating with said pump chamber to form a pump operative to discharge at least a portion of the material in said pump chamber through said discharge spout and to effect flow of material from said pouch into said pump chamber to replace the material which has been discharged, said pouch being at essentially ambient pressure and essentially free of compressible gas whereby ambient air pressure in said gap is operative to cause material in said pouch to flow into said pump chamber during operation of said pump, means cooperating with said pump chamber and said pouch to permit flow of material from said pouch to said pump chamber when said pump is actuated while preventing flow of material from said pump chamber into said pouch, means to prevent air from passing through said spout into the material located within said pump chamber as material flows from said pouch into said pump chamber, means to permit flow of ambient air into said air gap whereby said air gap is maintained at ambient air pressure, said pump chamber including spaced housing members forming a chamber of variable volume, said pump being operative in one position to reduce the volume of said pump chamber and in another position to effect flow of material from said pouch to said pump chamber to replace the material dispensed, said housing members including an upper and lower housing member, said upper housing member being supported by said body member and said lower housing member being assembled to and supported by said upper housing member, and said pouch including a portion received between said housing members and being sealingly supported thereby.

2. A pump type dispenser as set forth in claim 1 wherein said means to prevent air from passing through said spout is a one way check valve assembly.

3. A pump type dispenser as set forth in claim 1 wherein the material to be dispensed is a readily flowable fluent material.

4. A pump type dispenser as set forth in claim 1 wherein said means cooperating with said pump chamber and said pouch includes a flapper valve assembly at least a portion of which is part of said pouch.

5. A pump type dispenser as set forth in claim 1 wherein one of said housing members is rigid and the other is flexible.

6. A pump type dispenser as set forth in claim 5 wherein said lower housing is rigid.

7. A pump dispenser as set forth in claim 1 wherein said body member is of non-uniform cross-section along its length.

8. A pump type dispenser as set forth in claim 1 wherein said pump includes resilient means to return said pump to its original position.

9. A pump type dispenser as set forth in claim 1 wherein said fluent material is a viscous material and wherein said spout is configured with respect to the viscosity of said fluent material to inhibit flow of the fluent material from said spout back into said pump chamber.

10. A pump type dispenser as set forth in claim 4 wherein said flapper valve assembly is provided in said lower housing and includes at least one aperture formed in said lower housing.

11. A pump type dispenser as set forth in claim 10 wherein a plurality of apertures are provided in said lower pump housing.

12. A pump type dispenser as set forth in claim 10 wherein said aperture is located off-center with respect to the center axis of said body member.

13. A pump type dispenser for fluent material comprising:

a container having an upper pump housing and a lower pump housing and a body member, said body member including an interior wall portion forming a body chamber, a flexible and collapsible pouch supported within said body chamber with at least portions thereof spaced from the interior wall portion of said body member to form an air gap therebetween, said air gap being at essentially ambient pressure, said pouch containing the material to be dispensed, said pump housings forming a pump chamber and said upper housing including a discharge spout, said pump chamber being essentially filled with material to be dispensed and being normally at ambient atmospheric pressure, said upper housing being flexible and compressible and said lower housing being rigid, said housings cooperating to form a pump operative to discharge at least a portion of the material in said pump chamber through said discharge spout and to effect flow of material from said pouch into said pump chamber to replace the material which has been discharged, said pouch being essentially at ambient pressure and essentially free of compressible gas whereby ambient air pressure in said gap is operative to cause material in said pouch to flow into said pump chamber during operation of said pump, said pouch including one end thereof which is sealingly engaged between said lower housing and said body member and pouch to permit flow of material from said pouch to said pump chamber when said pump is actuated while preventing flow of material from said pump chamber into said pouch, said valve means including aperture means in said lower housing and at least a portion of said pouch portion which overlies said surface portion of said lower housing also overlies said aperture means, means to prevent air from passing through said spout into the material located within said pump chamber as material flows from said pouch into said pump chamber, and means to permit flow of ambient air into said air gap whereby said air gap is maintained at ambient air pressure.

14. A pump type dispenser as set forth in claim 13 wherein said discharge spout in said upper housing includes a check valve, and said fluent material being a flowable liquid.

15. A pump type dispenser as set forth in claim 13 wherein said body member is of non-circular cross-section.

* * * * *